US006323816B1

(12) United States Patent
Omuro

(10) Patent No.: US 6,323,816 B1
(45) Date of Patent: Nov. 27, 2001

(54) SECTOR BEAM ANTENNA WITH SCATTERING COMPONENT

(75) Inventor: Norihiko Omuro, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/690,659

(22) Filed: Oct. 17, 2000

(30) Foreign Application Priority Data

Oct. 19, 1999 (JP) ..... 11-297059

(51) Int. Cl.[7] ..... H01Q 13/00
(52) U.S. Cl. ..... 343/780; 343/772
(58) Field of Search ..... 343/780, 772, 343/775, 783, 786; H01Q 13/00

(56) References Cited

U.S. PATENT DOCUMENTS 4,482,898 * 11/1984 Dragone et al. ..... 343/781 P
5,579,021 * 11/1996 Lee ..... 343/780

OTHER PUBLICATIONS

Microwave Antenna Theory and Design—pp. 459, McGraw–Hill Book Company, Inc. (1949).

* cited by examiner

*Primary Examiner*—Hoanganh Le
(74) *Attorney, Agent, or Firm*—Ostrolenk, Faber, Gerb & Soffen, LLP

(57) ABSTRACT

A sector beam antenna with a scattering component, in which a desired radiation pattern can be obtained, is provided. The sector beam antenna with the scattering component provides parallel plates composed of two conductive plates disposed in parallel in which the distance between the parallel plates is longer than a half wavelength and shorter than one wavelength of a using wavelength, a primary radiator block having an H bend function disposed between the parallel plates, an input port opened at one of the parallel plates in order to supply power to the primary radiator block, and a scattering component made of a conductive material and disposed in parallel to an aperture being an opening end of the parallel plates in a state that a designated distance exists between the scattering component and the aperture. With this structure, the radiation pattern radiating from the aperture can be formed freely.

6 Claims, 5 Drawing Sheets

SECTOR BEAM ANTENNA WITH SCATTERING COMPONENT

BACKGROUND OF THE INVENTION

The present invention relates to a sector beam antenna with a scattering component, which has a desired radiation pattern.

DESCRIPTION OF THE RELATED ART

At a sector beam antenna, forming a sector beam having a desired radiation pattern is one of the important elements. In order to achieve this, generally, the desired radiation pattern is formed by using flares. In this case, the sector beam antenna must provide a sufficient wide directivity in a state that the flares are not attached.

However, in case that the electric field of a radio wave is parallel to parallel plates of the sector beam antenna, there is a problem that the beam is made to be already narrow in the state that the flares are not attached. At this time, the half power beam width is about 60 degrees. The reason why the beam is made to be narrow is explained. In case that the electric field direction of a radio wave propagating between the parallel plates is perpendicular to the parallel plates, the distance "h" between the parallel plates can be made to be an arbitrary distance being less than a half wavelength. Therefore, the shorter the distance "h" is, the smaller an aperture of the sector beam antenna is, and the radio wave propagating through the aperture have a wide directivity. Therefore, when the flares are used, the radiation pattern can be adjusted relatively freely.

On the other hand, in case that the electric field direction of the radio wave propagating between the parallel plates is parallel to the parallel plates, there is a condition that the distance "h" between the parallel plates must be longer than the half wavelength. Further, in order not to propagate a radio wave being a higher mode, the wavelength must be shorter than one wavelength. Based on these conditions mentioned above, it is necessary that the aperture width needs at minimum the half wavelength. In this case, as mentioned above, the radiation pattern becomes about 60 degrees, and it is difficult that a sector beam having more than 60 degrees is formed.

Propagating conditions of the radio wave in both cases that the electric field directions are parallel and perpendicular to the parallel plates at the antenna used parallel plates are described in "Microwave Antenna Theory and Design" edited by S. Silver, published by McGraw-Hill Book Company, Inc., pp. 459, 1949.

However, at the conventional propagating conditions mentioned above, only the conditions propagating the radio wave between the parallel plates are described, and it is not described that what kind of directivity (radiation pattern) can be obtained from this antenna. Even an antenna satisfied these conditions is actually manufactured, there is a problem that it is difficult to obtain a desired wide sector beam by only using flares.

SUMMARY OF THE INVENTION

It is therefore an object of the present invention to provide a sector beam antenna with a scattering component, in which a desired radiation pattern can be obtained.

According to a first aspect of the present invention for achieving the object mentioned above, there is provided a sector beam antenna with a scattering component, which forms a sector beam. The sector beam antenna with the scattering component provides parallel plates composed of two conductive plates disposed in parallel in which the distance between the parallel plates is longer than a half wavelength and shorter than one wavelength of a using wavelength, a primary radiator block having an H bend function disposed between the parallel plates, an input port opened at one of the parallel plates in order to supply power to the primary radiator block, and a scattering component made of a conductive material and disposed in parallel to an aperture being an opening end of the parallel plates in a state that a designated distance exists between the scattering component and the aperture.

According to a second aspect of the present invention, in the first aspect, the scattering component is made of a thin pole shaped conductive material or a thin plate shaped conductive material.

According to a third aspect of the present invention, in the first aspect, the sector beam antenna with the scattering component, which forms a sector beam, further provides scattering component fixing components for fixing the scattering component to the parallel plates, flares for forming a beam, and radio wave absorbing materials for absorbing a part of a radio wave disposed at the ends and inside bent surfaces of the flares According to a fourth aspect of the present invention, in the first aspect, a radio wave, in which the electric field of the radio wave is parallel to the parallel plates, is generated.

According to a fifth aspect of the present invention, in the first aspect, the sector beam antenna with the scattering component, which forms a sector beam, further provides a reflection block for making phases of beams radiating from the aperture equal or for making phases of beams radiating from the aperture not equal at the upper part and the lower part of the aperture.

According to a sixth aspect of the present invention, in the fifth aspect, the reflection block has a parabolic shape or a shape combined plural curve surfaces.

BRIEF DESCRIPTION OF THE DRAWINGS

The objects and features of the present invention will become more apparent from the consideration of the following detailed description taken in conjunction with the accompanying drawings in which.

DESCRIPTION OF THE PREFERRED EMBODIMENTS

Figure 1:
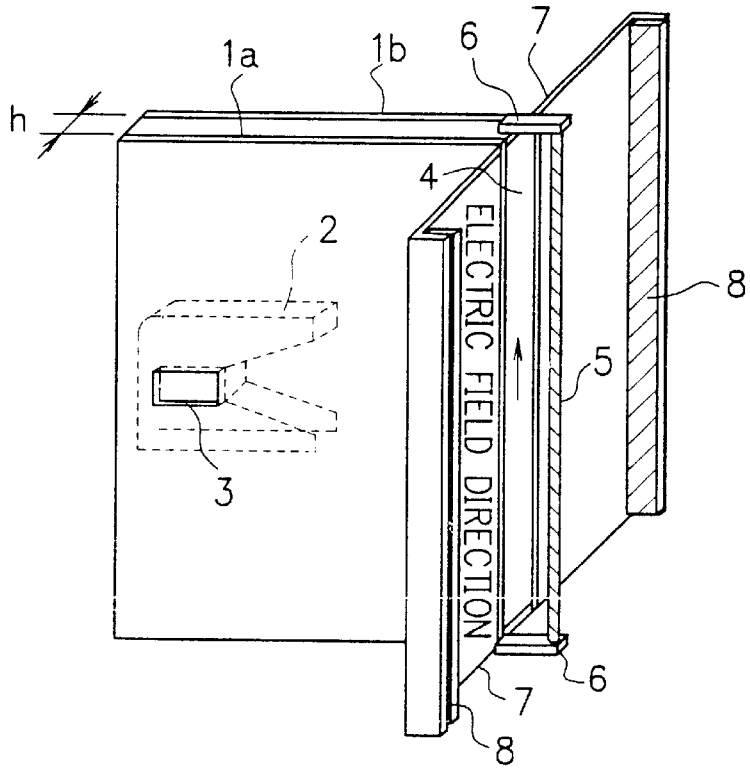
FIG. 1 is a perspective view of a first embodiment of a sector beam antenna with a scattering component of the present invention.
Figure 2:
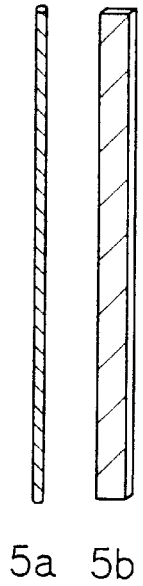
FIG. 2 is a diagram showing two kinds of scattering components applying to embodiments of the sector beam antenna with the scattering component of the present invention.

Referring now to the drawings, embodiments of the present invention are explained in detail. FIG. 1 is a perspective view of a first embodiment of a sector beam antenna with a scattering component of the present invention. As shown in FIG. 1, the first embodiment of the sector beam antenna with the scattering component of the present invention is an antenna in which a scattering component shaped a pole is disposed at an aperture of parallel plates. FIG. 2 is a diagram showing two kinds of scattering components applying to embodiments of the sector beam antenna with the scattering component of the present invention. In FIG. 2, a pole shaped scattering component 5*a* and a plate shaped scattering component 5*b* are shown.

As shown in FIG. 1, the first embodiment of the sector beam antenna with the scattering component of the present invention consists of parallel plates composed of a conductive plate 1*a* and a conductive plate 1*b* disposed in a state that these two conductive plates 1*a* and 1*b* are in parallel, a primary radiator block 2 having an H bend function and disposed between these two conductive plates 1*a* and 1*b*, an input port 3 opened at the conductive plate 1*a* and used to supply power to the primary radiator block 2, an aperture 4 being an opening end of the parallel plates, a scattering component 5 made of a conductive material and shaped a thin pole and disposed in parallel to the aperture 4 and having a designated distance from the aperture 4, scattering component fixing components 6 for fixing the scattering component 5, and flares 7 for forming a beam.

As shown in FIG. 1, the two conductive plates 1*a* and 1*b* are disposed in a state that the distance between the two conductive plates 1*a* and 1*b* is "h". The distance "h" is set to be about ⅔ of a using wavelength. In order that the electric field of the radio wave propagating in the parallel plates is parallel to the conductive plates 1*a* and 1*b* and the radio wave propagates stably, the distance "h " must be longer than a half wavelength and shorter than one wavelength.

In order that the radio wave inputted perpendicularly to the conductive plate 1*a* through the input port 3 being an interface to a waveguide (not shown) is propagated in the direction of the aperture 4, the primary radiator block 2 having the H bend function is provided.

Figure 3:
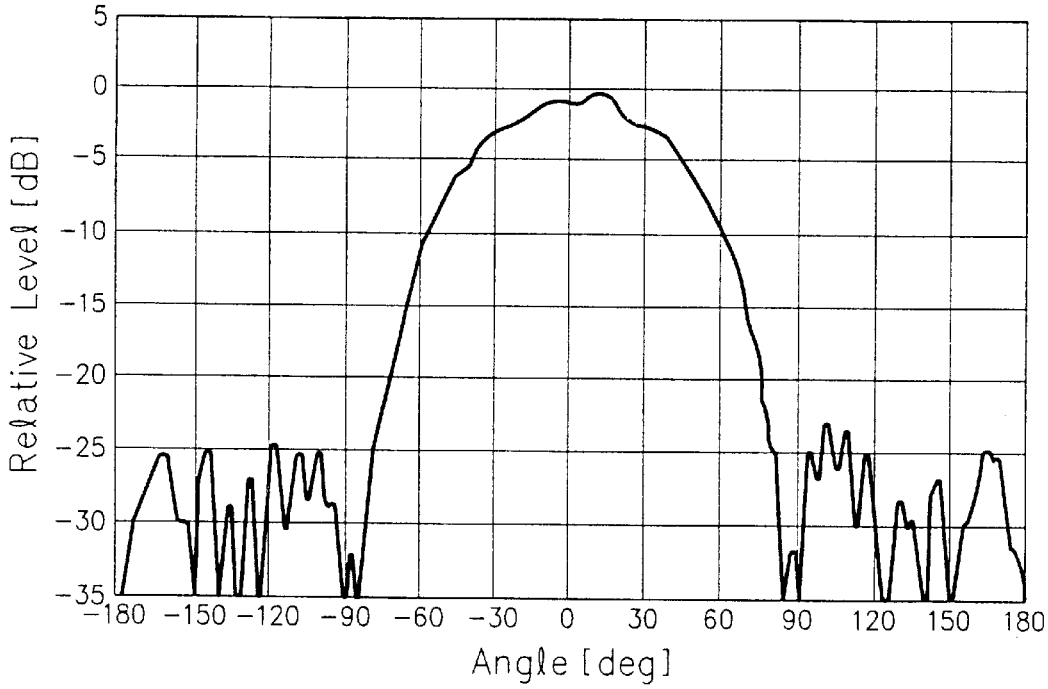
FIG. 3 is a graph showing a radiation pattern in the horizontal plane without a scattering component.

In this, by disposing the scattering component 5, an improved effect of the radiation pattern in the perpendicular plane (horizontal plane) to the scattering component 5 is shown by using actually measured data. FIG. 3 is a graph showing a radiation pattern in the horizontal plane without a scattering component. As shown in FIG. 3, since the distance "h" between the parallel plates is long, the radiation pattern from the aperture 4 is narrowed. Therefore, it is understandable that that even the shape of the flares 7 is changed variously in this state, a good effect is hardly obtained.

Figure 4:
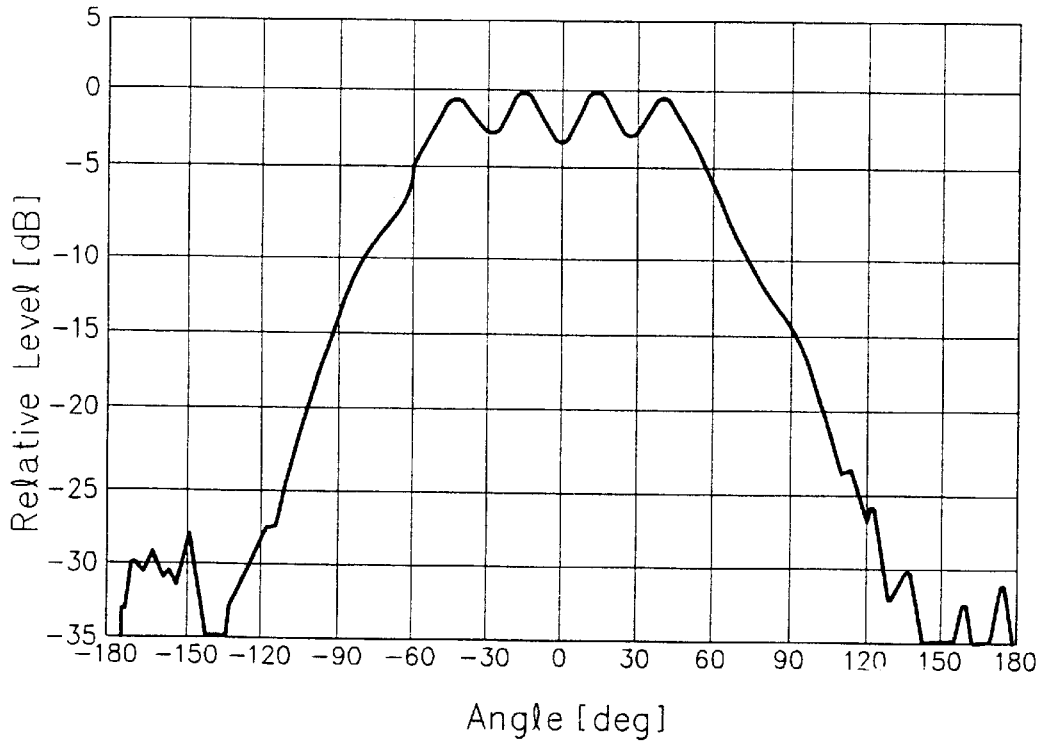
FIG. 4 is a graph showing a radiation pattern in the horizontal plane with the scattering component at the first embodiment of the sector beam antenna with the scattering component of the present invention.

FIG. 4 is a graph showing a radiation pattern in the horizontal plane with a scattering component at the first embodiment of the sector beam antenna with the scattering component of the present invention. In FIG. 4, a pole shaped scattering component whose diameter is 3 mm is used. As shown in FIG. 4, a sector beam from 90 to 120 degrees is formed, and it is understandable that the effect of the scattering component 5 is obtained.

At the first embodiment of the present invention, in the parallel plates whose distance "h" between the conductive plates 1*a* and 1*b* is longer than the half wavelength and shorter than the one wavelength, the electric field of the propagating radio wave is made to be parallel to the parallel plates by disposing the scattering component 5. This scattering component 5 is made of a conductive pole or plate, and is disposed in a state that the scattering component 5 is in parallel to the aperture 4 and has a designated distance from the aperture 4, in order to make the radio wave propagate.

The scattering component 5 made of the conductive material is disposed in parallel to the electric field direction of the radio wave propagating from the aperture 4 of the parallel plates. Therefore, in case that the length of the scattering component 5 is long enough in the electric field direction, the scattering component 5 works as a reflection plate.

When the scattering component 5 is disposed at a position where is a suitable distance away from the aperture 4, the radio wave directly reached from the aperture 4 and the radio wave scattered by reflecting the scattering component 5 are superimposed, as a result, an effect that a sector beam is radiated in the plane being perpendicular to the scattering component 5 is obtained.

Next, a second embodiment of a sector beam antenna with a scattering component of the present invention is explained. At the first embodiment, the pole shaped scattering component 5*a* (thin long pole) is used, however at the second embodiment, the plate shaped scattering component 5*b* is used instead of the pole shaped scattering component 5*a*. These scattering components are shown in FIG. 2. At the second embodiment, almost the same radiation pattern that the first embodiment has can be obtained by actual measurement.

Figure 5:
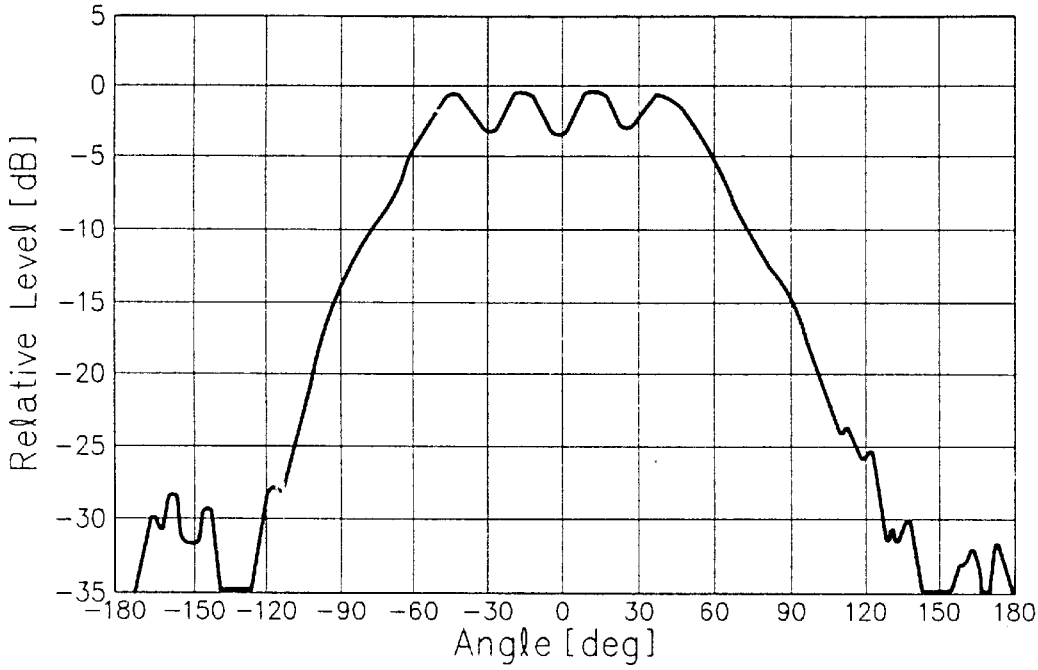
FIG. 5 is a graph showing a radiation pattern in the horizontal plane with a plate shaped scattering component whose thickness is 2mm at a second embodiment of the present invention.
Figure 6:
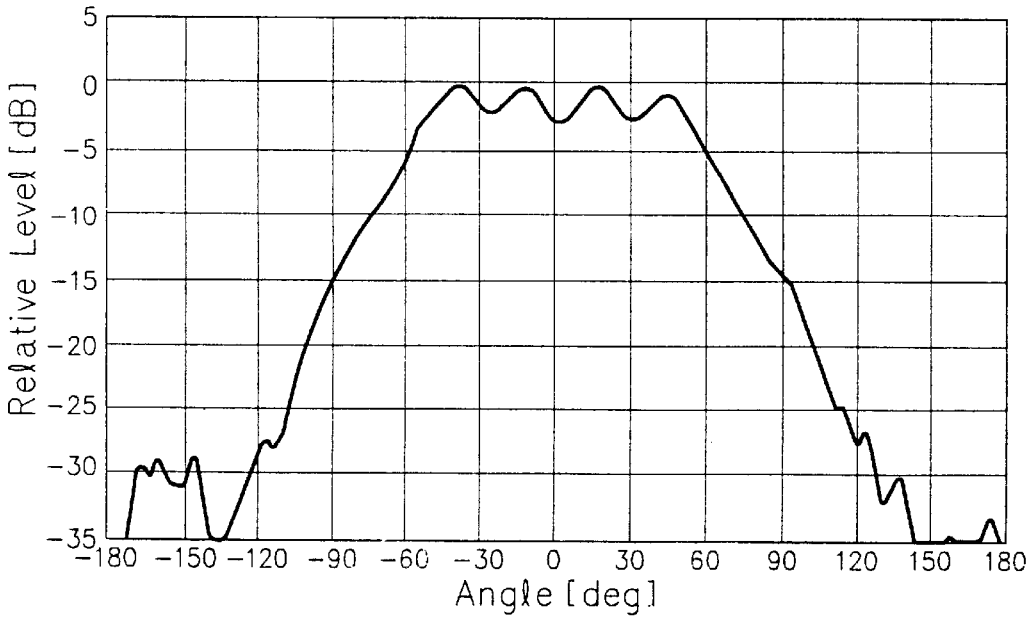
FIG. 6 is a graph showing a radiation pattern in the horizontal plane with a plate shaped scattering component whose thickness is 1 mm at the second embodiment of the present invention.

FIG. 5 is a graph showing a radiation pattern in the horizontal plane with a plate shaped scattering component whose thickness is 2 mm at the second embodiment of the present invention. FIG. 6 is a graph showing a radiation pattern in the horizontal plane with a plate shaped scattering component whose thickness is 1 mm at the second embodiment of the present invention. As mentioned above, at the first embodiment of the present invention, the scattering component 5 being the pole shaped scattering component whose diameter is 3 mm is used. At the second embodiment, in FIG. 5, a plate shaped scattering component made of a conductive material whose thickness is 2 mm and width is 4 mm is used. In FIG. 6, a plate shaped scattering component made of a conductive material whose thickness is 1 mm and width is 4 mm is used. In the first and second embodiments shown in FIGS. 4, 5, and 6, the center position in the horizontal direction of each scattering component 5 is the same.

Figure 7:
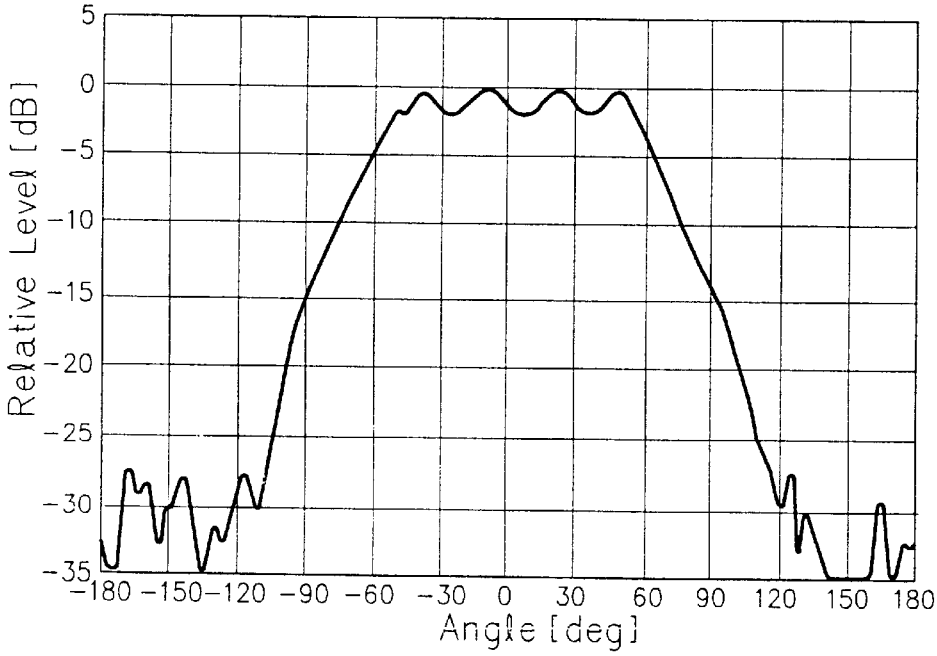
FIG. 7 is a graph showing a radiation pattern in the horizontal plane in which radio wave absorbing materials are added to the first embodiment shown in FIG. 4 at the ends and inside bent surfaces of the flares.

FIG. 7 is a graph showing a radiation pattern in the horizontal plane in which radio wave absorbing materials are added to the first embodiment shown in FIG. 4 at the ends and inside bent surfaces of the flares 7. As shown in FIG. 1, the radio wave absorbing materials 8 are added to the ends and inside bent surfaces of the flares 7. Therefore, as shown in FIG. 7, a radiation pattern in which ripples became small is obtained, compared with the radiation pattern in FIG. 4 at the first embodiment of the present invention.

Figure 8:
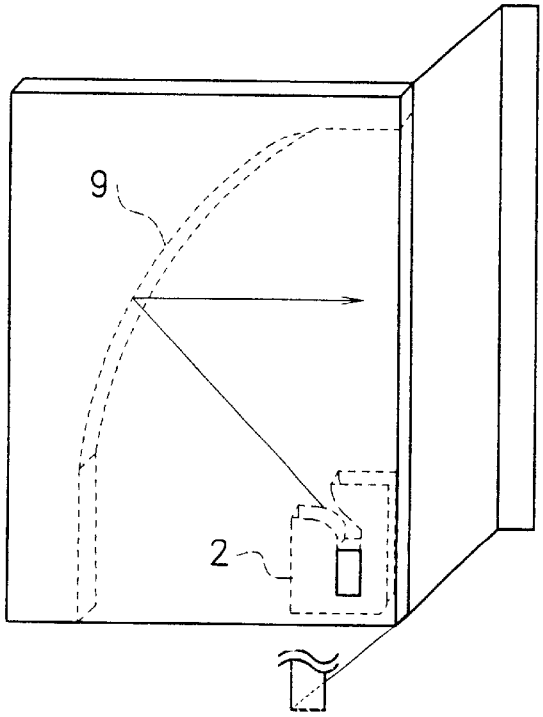
FIG. 8 is a perspective view showing a third embodiment of the sector beam antenna with the scattering component of the present invention.

FIG. 8 is a perspective view showing a third embodiment of the sector beam antenna with the scattering component of the present invention. At the first and second embodiments, the relation of the position between the primary radiator block 2 and the aperture 4 is not stipulated especially. However, at the sector beam antenna with the scattering component of the present invention, in case that the plane being perpendicular to the scattering component 5 is within the horizontal plane, the sector beam antenna with the scattering component of the present invention can be used as an antenna for a base station for a point to multi-point. In case that terminal stations are installed in a wide area for the base station, there is a case that it is desirable that by making the gain high, a relatively sharp beam is propagated in the elevation plane. In this case, in order to make phases at the aperture 4 equal, the primary radiator block 2 and a parabolic shaped reflection block 9 is considered to provide in a position shown in FIG. 8.

Further, in order to form the beam in the elevation plane into such as a radiation pattern having a cosecant-squared beam, instead of the parabolic shaped reflection block 9, plural parabolic curved surfaces, a combination of different kinds of curved surfaces, or an adjusted curved surface can be used as the reflection block 9.

Figure 9:
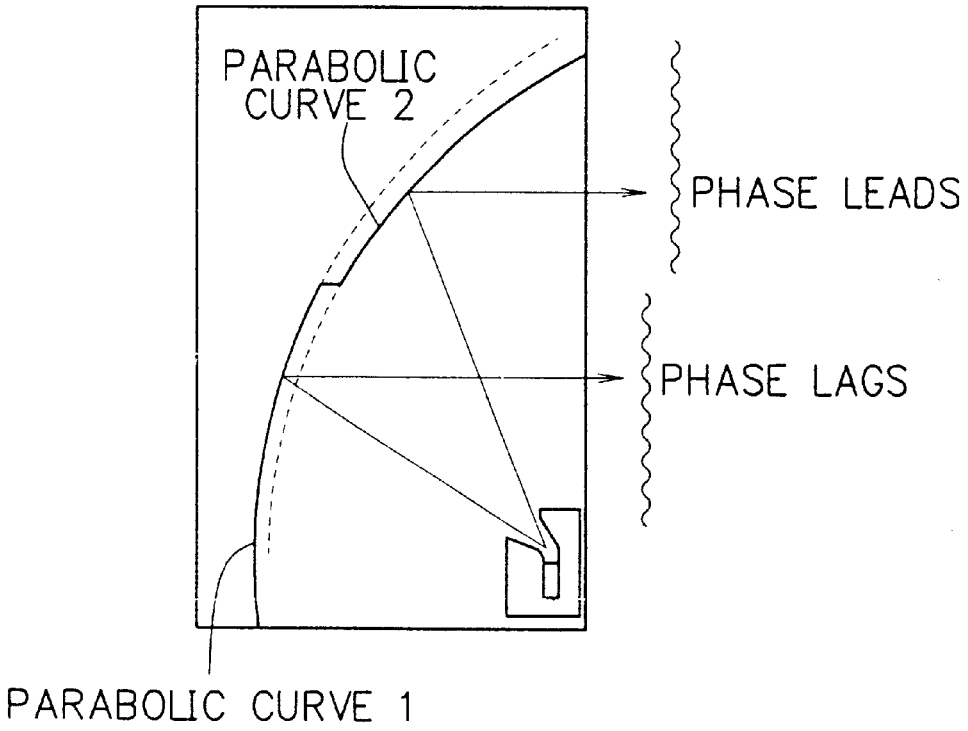
FIG. 9 is a diagram showing an example applied a reflection block composed of plural parabolic curves to the third embodiment of the sector beam antenna with the scattering component of the present invention shown in FIG. 8.
Figure 10:
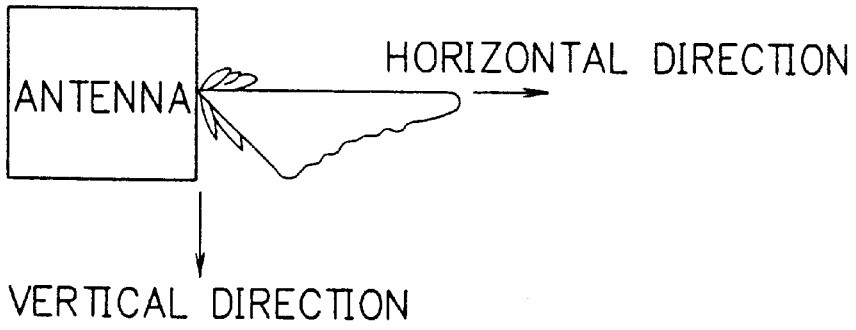
FIG. 10 is a diagram showing a simply expressed radiation pattern applied the reflection block to the sector beam antenna with the scattering component shown in FIG. 9.

FIG. 9 is a diagram showing an example applied a reflection block composed of plural parabolic curves to the third embodiment of the sector beam antenna with the scattering component of the present invention shown in FIG. 8. In FIG. 9, an example, in which beams are formed in the elevation plane of the reflection block 9, is shown. As shown in FIG. 9, in case that the shape of the reflection block 9 is composed of two parabolic carved surfaces whose focuses are common, as shown in FIG. 9, a phase difference occurs between the upper half and the lower half of the aperture 4. FIG. 10 is a diagram showing a simply expressed radiation pattern applied the reflection block to the sector beam antenna with the scattering component shown in FIG. 9. As shown in FIG. 10, it can be realized that an antenna having a characteristic in which a null point is hardly provided in the depression angle because the phase difference between the upper half and the lower of the aperture 4 occurred.

As mentioned above, the sector beam antenna with the scattering component of the present invention is an antenna utilizing that a radio wave propagates in two parallel plates. Further, at the sector beam antenna with the scattering component, in case that the distance between the two parallel plates is longer than a half wavelength and shorter than one wave length of the radio wave, and the electric field direction of the radio wave propagating in the two parallel plates is parallel to the two parallel plates, a scattering component made of a conductive pole or plate is disposed at a near position of an aperture of the two parallel plates in a state that the scattering component is parallel to the aperture. With the mentioned above structure, at the sector beam antenna with the scattering component of the present invention, a radiation pattern of the radio wave radiating from the aperture being a perpendicular plane to the two parallel plates can be formed freely.

While the present invention has been described with reference to the particular illustrative embodiments, it is not to be restricted by those embodiments but only by the appended claims. It is to be appreciated that those skilled in the art can change or modify the embodiments without departing from the scope and spirit of the present invention.

What is claimed is:

1. A sector beam antenna with a scattering component, which forms a sector beam, comprising:

parallel plates composed of two conductive plates disposed in parallel in which the distance between said parallel plates is longer than a half wavelength and shorter than one wavelength of a using wavelength;

a primary radiator block having an H bend function disposed between said parallel plates;

an input port opened at one of said parallel plates in order to supply power to said primary radiator block; and a scattering component made of a conductive material and disposed in parallel to an aperture being an opening end of said parallel plates in a state that a designated distance exists between said scattering component and said aperture.

2. A sector beam antenna with a scattering component, which forms a sector beam, in accordance with claim 1, wherein:

said scattering component is made of a thin pole shaped conductive material or a thin plate shaped conductive material.

3. A sector beam antenna with a scattering component, which forms a sector beam, in accordance with claim 1, further comprising:

scattering component fixing components for fixing said scattering component to said parallel plates;

flares for forming a beam; and radio wave absorbing materials for absorbing a part of a radio wave disposed at the ends and inside bent surfaces of said flares.

4. A sector beam antenna with a scattering component, which forms a sector beam, in accordance with claim 1, wherein:

a radio wave, in which the electric field of said radio wave is parallel to said parallel plates, is generated.

5. A sector beam antenna with a scattering component, which forms a sector beam, in accordance with claim 1, further comprising:

a reflection block for making phases of beams radiating from said aperture equal or for making phases of beams radiating from said aperture not equal at the upper part and the lower part of said aperture.

6. A sector beam antenna with a scattering component, which forms a sector beam, in accordance with claim 5, wherein:

said reflection block has a parabolic shape or a shape combined plural curve surfaces.

* * * * *